US005280764A

United States Patent [19]

Levinrad

[11] Patent Number: 5,280,764

[45] Date of Patent: Jan. 25, 1994

[54] DISPENSER ACCESSORY TO FACILITATE LOADING MOTTLES IN A DISPENSER

[76] Inventor: Maxim D. Levinrad, P.O. Box 808, 42107 Natania, Israel

[21] Appl. No.: 887,945

[22] Filed: May 26, 1992

[30] Foreign Application Priority Data

May 31, 1991 [IL] Israel ..... 98328

[51] Int. Cl.[5] ..... B65B 3/04; B67D 3/00

[52] U.S. Cl. ..... 141/330; 222/81; 222/89; 222/83.5; 222/88; 141/375; 141/363

[58] Field of Search ..... 141/329, 330, 375, 363; 222/83, 83.5, 185, 81

[56] References Cited

U.S. PATENT DOCUMENTS

| | | | |
|---|---|---|---|
| 1,028,542 | 6/1912 | Christian | 141/330 |
| 1,142,210 | 6/1915 | Wagner . | |
| 1,241,352 | 9/1917 | Doering et al. | 141/330 |
| 2,687,829 | 8/1954 | Horrocks | 141/330 |
| 2,739,466 | 3/1956 | Maliniak | 141/375 |
| 3,774,722 | 11/1973 | Elder | 141/330 |
| 4,133,319 | 1/1979 | Bloomfield | 222/83.5 X |
| 4,597,423 | 7/1986 | Chenot | 141/330 |
| 4,846,236 | 7/1989 | Deruntz | 141/329 |
| 5,048,723 | 9/1991 | Seymour | 222/81 |

*Primary Examiner*—Ernest G. Cusick
*Attorney, Agent, or Firm*—Benjamin J. Barish

[57] ABSTRACT

An accessory effective to pierce the seal closing the mouth of a bottle when the bottle, filled with a pourable material, is applied in inverted position to a well of a dispenser, with a shoulder of the bottle engaging a rim of the well to support the bottle in inverted position in the well. The accessory is placed in the well of a dispenser and includes a collar placeable against the rim of the well before the bottle is inserted in inverted position into the well. A piercing member is carried by the collar for piercing the bottle seal when the bottle is placed in inverted position into the collar.

9 Claims, 3 Drawing Sheets

FIG. 5
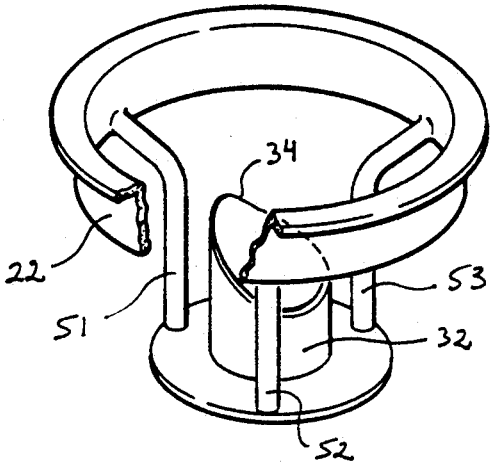
FIG. 6
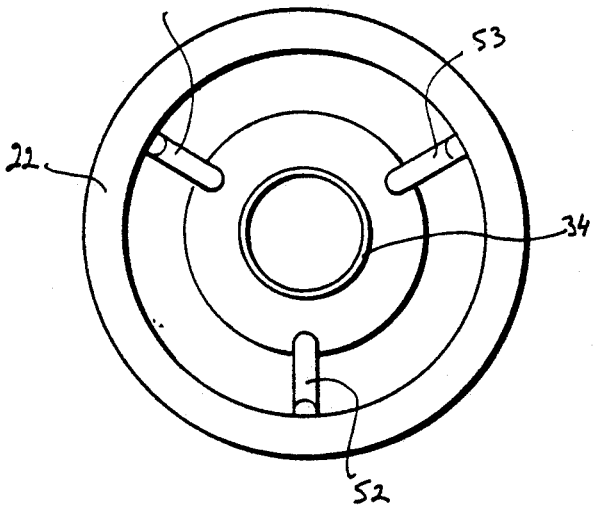
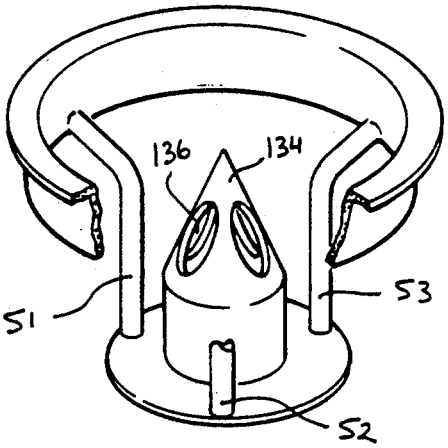
FIG. 7

DISPENSER ACCESSORY TO FACILITATE LOADING MOTTLES IN A DISPENSER

FIELD AND BACKGROUND OF THE INVENTION

The present invention relates to a dispenser accessory to facilitate loading bottled liquids, or other pourable material, in a dispenser, such as a water cooler or a beverage dispenser.

A type of water dispenser presently in common use utilizes large water bottles which when full weigh about 20 Kg. These bottles normally include a seal across the mouth of the bottle which seal is to be removed before the bottle is inserted in inverted position into a cylindrical well of the dispenser. This is usually done by first removing the seal and then quickly inverting the bottle while placing it into the dispenser well. Performing this operation without spilling water is very difficult and requires substantial strength and agility.

OBJECTS AND BRIEF SUMMARY OF THE INVENTION

An object of the present invention is to provide an accessory which permits a bottle to be loaded into a dispenser without first removing its seal.

According to the present invention, there is provided an accessory to facilitate loading a bottle containing a pourable material in an inverted position in a well of a dispenser, comprising: a mounting member mountable in the well; and a piercing member carried by the mounting member and oriented to engage and pierce a seal closing the mouth of the bottle when the bottle is applied in inverted position into the well.

According to a described preferred embodiment, the mounting member comprises a collar having an out-turned peripheral flange adapted to seat on a rim of the well; and a bottom wall secured to the collar in axially-spaced relation thereto for underlying the mouth of the bottle when the bottle is supported in inverted position in the well with a shoulder on the bottle supported on the rim of the well. The piercing member is secured to the bottom wall of the mounting member.

According to further features in one preferred embodiment of the invention described below, the piercing member is constituted of a cutting edge formed at a bias at the upper end of a sleeve secured to the bottom wall and aligned with an opening therethrough. The cutting edge is formed with a pointed tip at its highest portion to facilitate the initial penetration of the seal by the piercing member; in addition, the cutting edge terminates in a blunted edge at its lowest portion to form a connecting web between the cut part of the seal and the remainder of the seal preventing the cut part from completely separating from the remainder of the seal.

As will be more readily apparent from the description below, an accessory constructed in accordance with the foregoing features may be placed and left in place in the cylindrical well of the dispenser, whereupon it permits the bottle, while full and still sealed, to be applied in inverted position to the dispenser without first removing the seal. Thus the weight of the bottle itself will automatically cause the piercing member to pierce the bottle seal. The sealed bottle may therefore be gripped with two hands or by two persons, and applied into the well of the dispenser, thereby greatly facilitating the replacement of an empty bottle with a full bottle.

Further features and advantages of the invention will be apparent from the description below.

BRIEF DESCRIPTION OF THE DRAWINGS

The invention is herein described, by way of example only, with reference to the accompanying drawings, wherein:

FIGS. 5 and 6 are perspective and top views, respectively, of another accessory in accordance with this invention;

and FIG. 7 illustrates another type of piercing element that may be used in the accessory.

DESCRIPTION OF A PREFERRED EMBODIMENT

Figure 1:
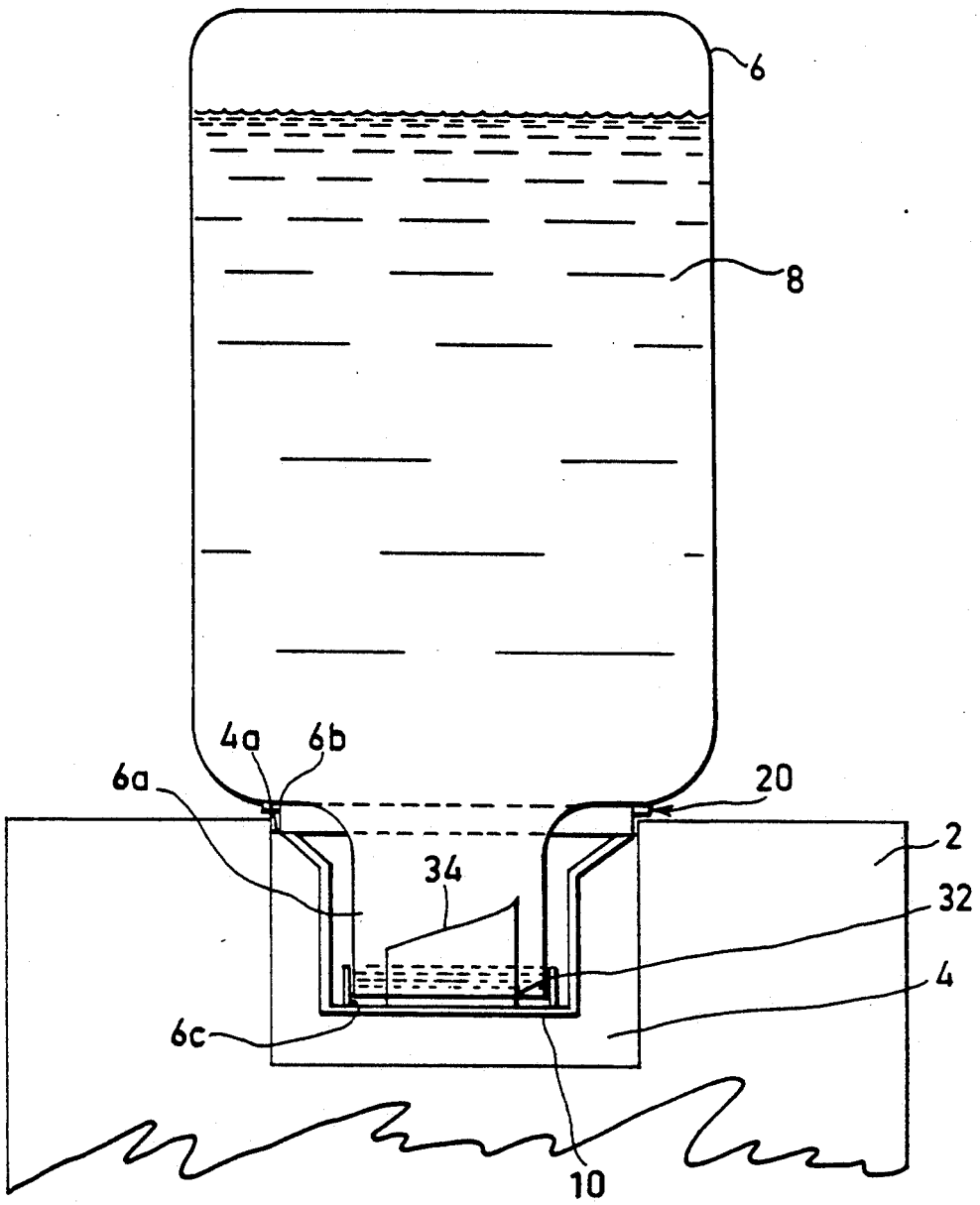
FIG. 1 is a transverse sectional view illustrating an accessory constructed in accordance with the present invention mounted in a dispenser and receiving a bottle of water or other liquid or pourable material.

With reference first to FIG. 1, there is illustrated a portion of a dispenser, such as a water cooler or the like generally designated 2, formed with a cylindrical well 4 circumscribed by a rim 4*a* for receiving a bottle 6 of a liquid 8, such as water, a beverage, or a liquid chemical. Such bottles are applied in inverted position to the dispenser 2 with the shoulder 6*b* of the bottle resting against the well rim 4*a*, and the neck 6*a* of the bottle received within the dispenser well 4 and spaced from the bottom of the well. The arrangement permits the liquid 8 within the bottle to flow into the well, and from there to be dispensed. The present invention does not concern the dispenser structure, and therefore details of the dispenser structure are not set forth herein.

The bottles 6 are normally supplied with a seal 10 adhered to the outer edge of the bottle mouth 6*c*. Normally, the seal 10 is first removed before the bottle 6 is applied to the dispenser. In existing dispensers, this usually requires the person either to quickly invert and apply the bottle to the well, or to close the bottle mouth 6*c* with one hand while quickly removing the hand and inserting the bottle 6 in inverted position into the well 4. As briefly mentioned earlier, such a manner of handling the bottle 6 is very awkward and difficult, particularly when large bottles weighing in the order of 20 kilograins are involved.

The present invention provides an accessory, generally designated 20, which may be applied over well 4 of the dispenser 2 and, when so applied, greatly facilitates the application of filled bottles 6 to the dispenser 2.

Figure 3:
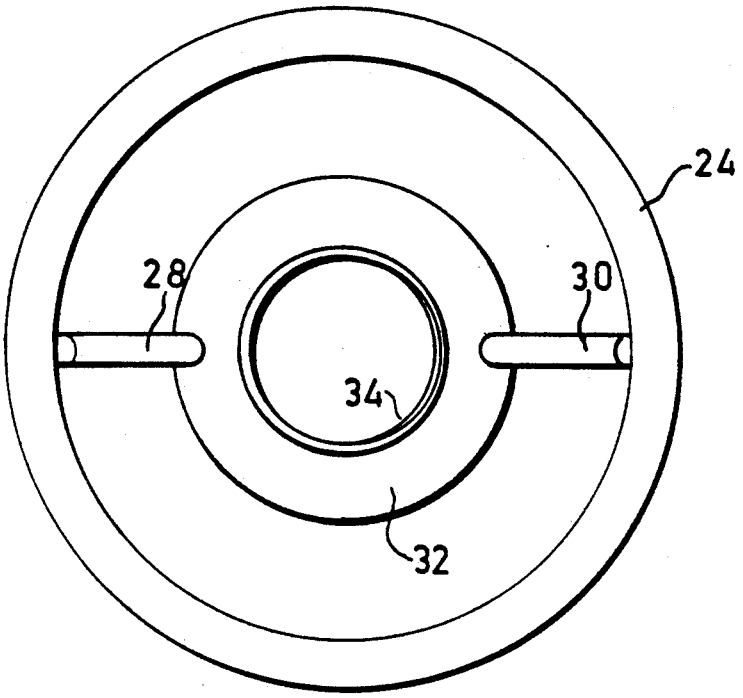
FIG. 3 is a top plan view illustrating the accessory of FIG. 1.
Figure 2:
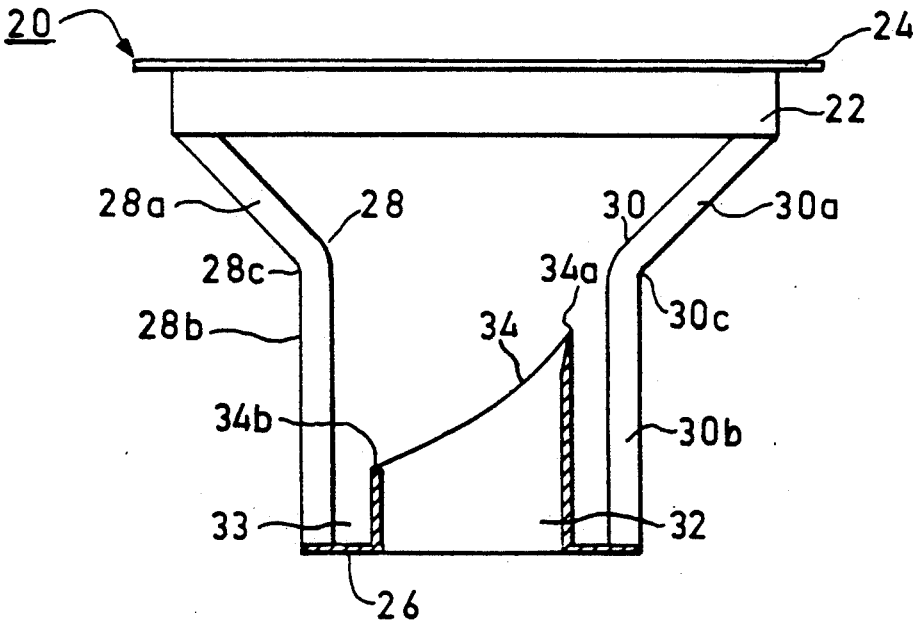
FIG. 2 is an enlarged sectional view illustrating the accessory of FIG. 1.

The accessory 20, as more particularly illustrated in FIGS. 2 and 3, comprises a circular mounting collar 22 having an out-turned peripheral flange 24 adapted to seat on the rim 4*a* of the dispenser well 4, as shown in FIG. 1. The accessory further includes a bottom wall 26 secured to the mounting collar 22 in axially-spaced relation thereto by a pair of arms 28, 30, connecting diametrically opposite sides of the bottom wall to the collar. Bottom wall 26 is of smaller diameter than that of collar 22, and therefore the arms 28, 30 are formed with a converging section 28*a*, 30*a* adjacent the collar 22, a straight section 28*b*, 30*b* adjacent the bottom wall 26, and a juncture section 28*c*, 30*c* therebetween.

Bottom wall 26 carries a cylindrical sleeve 32 facing the mounting collar 22 and of smaller diameter than the bottom wall 26 so as to define an annular space 33 between the sleeve and the two arms 28, 30. Annular space 33 is large enough to accommodate the bottle neck 6*a* when the bottle is applied in inverted position to the dispenser 2, as shown in FIG. 1, and thereby centralizes the bottle. Sleeve 32 is open at both ends to permit the liquid contents of the bottle to flow through the sleeve when in this inverted position.

Figure 4:
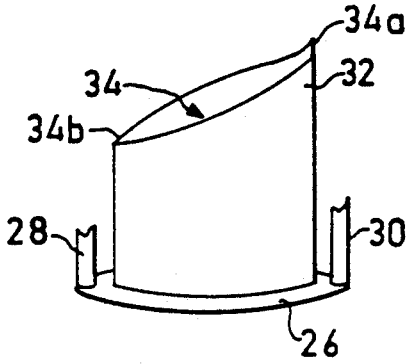
FIG. 4 is a fragmentary view illustrating the construction of the piercing member in the accessory of FIG. 1.

The upper end of sleeve 32 is formed as a cutting edge 34 and extends at a bias to the bottom wall 26 so as to pierce the seal 10 across the bottle mouth 6*c* when the bottle is inserted in inverted position into the well 4 of the dispenser 2. As shown particularly in FIG. 4, the highest portion of the cutting edge 34 is formed with a pointed tip 34*a*, to facilitate the initial penetration of the seal.

The manner of using the illustrated accessory will be apparent from the above description. The accessory is placed over well 4 of the dispenser 2 by seating flange 24 of the mounting collar 22 over the rim 4*a* of the well, as shown in FIG. 1. The bottle 6 may then be easily applied over the accessory without removing the seal 10. Thus, the bottle may be held by both hands in inverted position and then lowered with its neck 6*a* aligned with the annular space 33 between sleeve 32 and the arms 28, 30 of the accessory until the bottle shoulder 6*b* rests against the rim 4*a* of the dispenser well 4. The weight of the bottle will cause the cutting edge 34 to cut through the seal 10 as the bottle is lowered and the mouth 6*c* of the bottle moves toward the bottom wall 26. In the final position of the bottle as illustrated in FIG. 1, the cutting edge 34 of the sleeve has completely pierced through the seal 10 closing the bottle mouth 6*c* whereupon the contents 8 of the bottle may flow through sleeve 32 into well 4, for dispensing by the dispenser 2.

Sleeve 32 has a blunt edge 34*b* at its low point, remote from its pointed tip 34*a* so that the cutting edge 34 does not completely cut through the seal, but rather leaves an uncut section intact. The cut portion of the seal will thus not separate from the remainder of the seal adhering to the bottle mouth.

FIGS. 5 and 6 illustrate another construction, similar to that in FIGS. 1–4, except that instead of having only two arms (28, 30) for mounting the piercing element 34 to the collar 22, the accessory includes three such arms 51, 52, 53, each of the angled construction described above with respect to arms 28 and 30. A three-arm construction as shown in FIGS. 5 and 6 better guides the mouth of the bottle into the annular space (33, FIG. 2) when inserting the bottle in the inverted position over the accessory.

FIG. 7 illustrates a further variation, wherein the piercing element, therein designated 134, is of a hollow conical construction and is formed with a plurality of openings 136 through which the liquid flows when pierced by the piercing element. In all other respects, the accessory illustrated in FIG. 7 is constructed as in FIGS. 5 and 6, but may also be constructed as in FIGS. 1–4.

Many other variations, modifications and applications of the invention will be apparent.

What is claimed is:

1. A dispenser accessory to facilitate loading a bottle containing a pourable material in an inverted position in a well of a dispenser, comprising: a mounting member mountable in said well; and a piercing member carried by said mounting member and oriented to engage and pierce a seal closing the mouth of the bottle when the bottle is applied in inverted position into said well; said mounting member comprising a collar having an out-turned peripheral flange adapted to seal on a rim of the well; and a bottom wall secured to said collar in axially-spaced relation thereto for underlying the mouth of the bottle when the bottle is supported in inverted position in the well with a shoulder on the bottle supported on said rim of the well; said piercing member being secured to said bottom wall; said bottom wall being secured to said collar by a plurality of circumferentially-spaced arms converging towards each other from the collar in the direction of said bottom wall, for guiding the mouth of the bottle into an annular space between the arms and the piercing member; each of said arms being formed with a converging section adjacent the collar joined to a straight section adjacent the bottom wall.

2. The accessory according to claim 1, wherein said piercing member is constituted of a cutting edge formed at a bias at the upper end of a sleeve secured to said bottom wall and aligned with an opening therethrough.

3. The accessory according to claim 2, wherein said cutting edge is formed with a pointed tip at its highest portion to facilitate the initial penetration of the seal by the piercing member.

4. The accessory according to claim 3, wherein the sleeve is formed with a blunt edge for a portion thereof preventing the cut part from completely separating from the remainder of the seal.

5. The accessory according to claim 1, wherein said bottom wall is circular and of smaller outer diameter than said collar.

6. The accessory according to claim 1, wherein there are two of said arms.

7. The accessory according to claim 1, wherein there are three of said arms equally spaced around the circumference of the collar.

8. The accessory according to claim 1, wherein said piercing member is of a hollow conical configuration and is formed with openings for the passage of the liquid therethrough after the seal has been pierced.

9. A dispenser accessory to facilitate loading a bottle containing a pourable material in an inverted position in a well of a dispenser, comprising:

a mounting member mountable in said well;

and a piercing member carried by said mounting member and oriented to engage and pierce a seal closing the mount of the bottle when the bottle is applied in an inverted position into said well;

said mounting member comprising a collar having an out-turned peripheral flange adapted to seat on a rim of the well; and a bottom wall secured to said collar in axially-spaced relation thereto for underlying the mount of the bottle when the bottle is supported in inverted position in the well with a shoulder on the bottle supported on said rim of the well;

said piercing member being by a cutting edge formed at a bias at the upper end of a sleeve secured to said bottom wall and aligned with an opening therethrough;

said cutting edge being formed with a pointed tip at its highest portion to facilitate the initial penetration of the seal by the piercing member, and with a blunt edge at its lowest portion preventing the cut part of the seal from completely separating from the remainder of the seal;

said bottom wall being secured to said collar by a plurality of circumferentially-spaced arms converging towards each other from the collar in the direction of said bottom wall, for guiding the mount of the bottle into an annular space between the arms and the piercing member;

each of said arms being formed with a converging section adjacent the collar joined to a straight section adjacent the bottom wall.

* * * * *